US005988789A

United States Patent [19]

Nakahara

[11] Patent Number: 5,988,789

[45] Date of Patent: Nov. 23, 1999

[54] HEAD CAP MOVEMENT MECHANISM AND RECOVERY DEVICE FOR AN INK JET PRINTER

[75] Inventor: Junji Nakahara, Nagoya, Japan

[73] Assignee: Brother Kogyo Kabushiki Kaisha, Nagoya, Japan

[21] Appl. No.: 08/747,387

[22] Filed: Nov. 12, 1996

[30] Foreign Application Priority Data

Nov. 20, 1995 [JP] Japan ..... 7-326604

[51] Int. Cl.[6] ..... B41J 2/165

[52] U.S. Cl. ..... 347/32

[58] Field of Search ..... 342/32, 33, 29, 342/31; 347/33, 29, 31, 32

[56] References Cited

U.S. PATENT DOCUMENTS

| | | | |
|---|---|---|---|
| 5,138,343 | 8/1992 | Aichi et al. . | |
| 5,164,748 | 11/1992 | Katayanagi et al. . | |
| 5,170,186 | 12/1992 | Shimamura et al. . | |
| 5,343,228 | 8/1994 | Takada | 347/29 |
| 5,406,317 | 4/1995 | Shimamura et al. . | |
| 5,437,444 | 8/1995 | Kawakami et al. | 271/22 |
| 5,639,220 | 6/1997 | Hayakawa . | |
| 5,677,715 | 10/1997 | Beck | 347/29 |
| 5,730,538 | 3/1998 | Kato | 347/33 |

FOREIGN PATENT DOCUMENTS

| | | | |
|---|---|---|---|
| 0 630 754 A2 | 12/1994 | European Pat. Off. . | |
| 62-263058 | 11/1987 | Japan . | |
| 1-264853 | 10/1989 | Japan | 347/24 |
| 3-234637 | 10/1991 | Japan . | |

*Primary Examiner*—N. Le
*Assistant Examiner*—Thien Tran
*Attorney, Agent, or Firm*—Oliff & Berridge, PLC

[57] ABSTRACT

In an ink jet printer, a carriage carrying print heads engages with a print head cap support member when the carriage reaches a position where the print heads are positioned opposite to a print head cap supported on the print head cap support member during its movement toward a capping position where the print heads are capped with the print head cap, and moves together with the print head cap support member. As the carriage moves further toward the capping position, an operating member is operated by a cam to operate the print head cap so as to move toward the print heads for capping operation. Thus, the movement of the carriage and the capping operation of the print head cap are perfectly and accurately synchronized. A purging unit is driven through a gearing including a pump driving cam gear by a line feed motor.

12 Claims, 4 Drawing Sheets

HEAD CAP MOVEMENT MECHANISM AND RECOVERY DEVICE FOR AN INK JET PRINTER

BACKGROUND OF THE INVENTION

1. Field of the Invention

The invention relates to an ink jet printer and, more particularly, to a driving system for carrying out maintenance work for a print head included in an ink jet printer.

2. Description of Related Art

Some known ink jet printers having a print head are provided with a cap for capping the print head to prevent the faulty ink particle jetting operation of the print head due to the clogging of the nozzles of the print head with dried ink and to maintain the print head in an operational condition. Some of those known ink jet printers are provided with a purging device to prevent the faulty ink particle jetting operation of the print head due to the generation of bubbles in the ink contained in the print head or the adhesion of ink particles to the outlet openings of the nozzles and to restore a satisfactory ink particle jetting condition. The purging device creates a negative pressure through a cap by a suction pump to purge the nozzles of the print head of ink.

In such a known ink jet printer, the cap is operated to cap the print head by a special driving source for driving the cap for movement toward the print head or by a line feed motor for feeding a recording medium.

The cost of the ink jet printer increases when the ink jet printer is also provided with the special driving source for the maintenance of the print head. When the line feed motor is used also for moving the cap, the cap is moved to cap the print head after the print head has been moved to and stopped at a capping position opposite the cap because it is difficult to synchronize the capping action of the cap with the movement of a carriage carrying the print head. Therefore, it takes time to cap the print head with the cap. A color ink jet printer requires more time for the maintenance operation because the color ink jet printer has four print heads and capping and uncapping operations must be carried out every time one of the four print heads is moved to carry out a purge operation for each of the four print heads.

SUMMARY OF THE INVENTION

The invention has been made to solve the foregoing problems and it is therefore an object of the invention to provide an ink jet printer having a plurality of print heads, capable of reducing time necessary for a maintenance operation, such as a print head capping operation, and of being fabricated at a relatively low cost.

According to a first aspect of the invention, an ink jet printer, having print heads with nozzles through which ink particles are jetted mounted on a carriage and capable of printing on a recording medium while the carriage is being driven for movement across the recording medium by a carriage driving means, comprises a print head cap for capping the print heads to prevent ink from drying in the nozzles of the print heads disposed outside a printing range in which the recording medium is printed; a print head cap supporting means disposed so as to engage with the carriage moving toward a capping position where the print heads are positioned opposite to the print head cap and capable of being driven by the moving carriage so as to move the print head cap toward the print heads to cap the print heads with the print head cap; a suction means disposed outside a printing range in which the recording medium is printed and comprising a suction cap to be placed over the nozzles of the print heads and a suction pump for sucking ink from the nozzles of the print heads through the suction cap; and a separate suction means driving means having a driving source for driving the suction means different from a carriage driving source for driving the carriage.

As the carriage approaches the capping position where the print heads are positioned opposite to the print head cap, the carriage comes into engagement with the cap supporting means to move the print head cap toward the print heads to cover the nozzles of the print heads. Thus, the movement of the print head cap toward the print heads is started in perfect synchronism with the movement of the carriage so that the respective operations of the carriage and the print head cap are accurately phased. Because a special driving means for driving the print head cap is unnecessary, the cost of the ink jet printer can be reduced accordingly. Since the capping operation for capping the print heads with the print head cap is started while the carriage is moving and progresses as the carriage moves, the time necessary for capping the print heads can be reduced. Also, because the suction means and the carriage are driven for operation by the separate driving means, the capping operation can quickly be accomplished without depending on the sucking operation of the suction means so that the drying of ink in the print heads can be prevented.

The print head cap supporting means may comprise a print head cap support member movable in substantially the same direction as that of the carriage when the carriage engages with the print head cap support member, and a print head cap moving means for operating the print head cap support member to move the print head cap in a direction substantially perpendicular to the direction of movement of the carriage.

Since the print head cap support member is moved in substantially the same direction as that of the carriage, and the print head cap moving means operates the print head cap support member so as to move the print head cap in a direction substantially perpendicular to the direction of movement of the carriage, the movement of the carriage and the capping movement of the print head cap are perfectly synchronized and, consequently, the print heads can accurately and quickly be capped with the print head cap.

The print head cap moving means may be a cam having a cam surface inclined so as to deviate toward the print heads from the moving direction of the carriage.

As the cam has the inclined surface inclined so as to deviate toward the print heads from the moving direction of the carriage, the direction of transmission of the movement of the print head cap support member can be converted with reliability so that the print heads can surely be capped with the print head cap.

The suction means driving means may comprise a cam for moving the suction cap toward and away from the print heads and a cam driving the suction pump.

The cams of the suction means driving means carry out operations for capping the print heads with the suction cap and driving the suction pump perfectly synchronously so that a series of sucking operations can surely be accomplished.

A driving source for moving the recording medium may be used also as the driving source of the suction means driving means.

When the suction means is driven by the driving means for moving the recording medium, and the print head cap is driven by the moving carriage, the maintenance operation does not need an additional driving source and hence the cost of the ink jet printer can be reduced.

The suction means driving means may connect the driving source to the cam substantially simultaneously with the engagement of the carriage with the supporting member.

When the driving means is thus connected to the cam, the driving force of the driving means can be transmitted to the suction means only when the transmission of the driving force of the driving means to the suction means is necessary to carry out the maintenance operation. Hence, the frequency of operation for driving the suction means can be reduced, whereby the life of the suction means can be extended. Because the operation for capping the print heads with the print head cap and the operation for connecting the suction means to the driving means are carried out by moving the carriage to the substantially same position, the moving range of the carriage may be relatively narrow. Thus, the ink jet printer can be formed having a relatively narrow width.

The carriage may be moved to a position where the print head cap comes into close contact with the nozzles of the print heads and may be moved further toward the suction cap to make the suction means carry out the sucking operation.

Since the carriage is moved to a position where the print head cap comes into close contact with the nozzles of the print heads and the suction means starts its sucking operation after the carriage has moved further toward the suction cap, wasted movement of the carriage is reduced and time necessary for the sucking operation is reduced.

BRIEF DESCRIPTION OF THE DRAWINGS

A preferred embodiment of the invention will be described in detail with reference to the accompanying drawings, wherein.

DESCRIPTION OF THE PREFERRED EMBODIMENT

Figure 1:
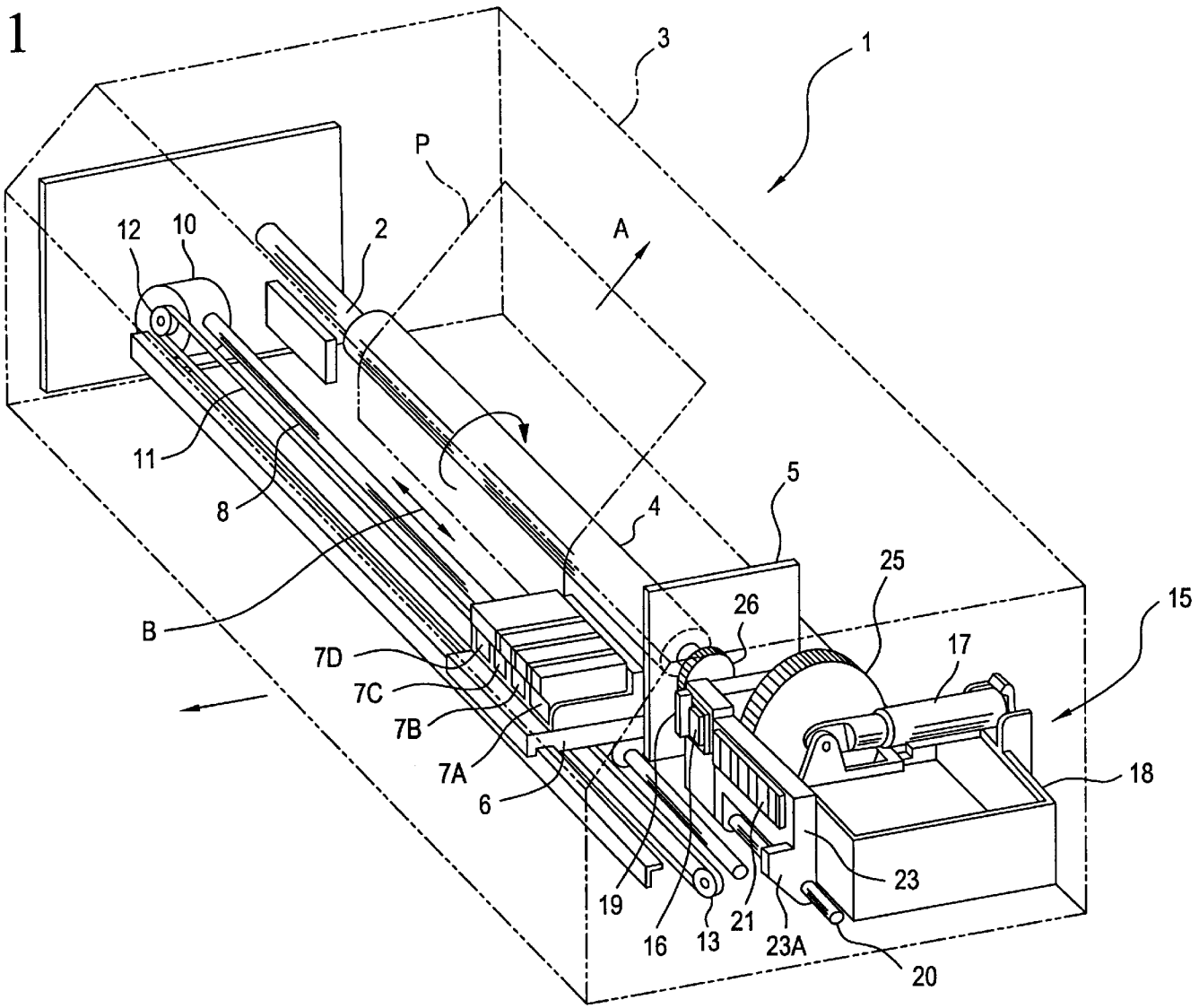
FIG. 1 is a schematic perspective view of an ink jet printer in a preferred embodiment according to the invention.

An ink jet printer in a preferred embodiment according to the invention will be described hereinafter with reference to the accompanying drawings. FIG. 1 shows the ink jet printer 1 in a schematic perspective view. The ink jet printer 1 has a cylindrical platen roller 4 supported for rotation by a transverse shaft 2 on a frame 3. The platen roller 4 supports a recording sheet P, i.e., a recording medium, fed thereto from a sheet feed cassette or a manual sheet feed unit opposite to print heads 5. The platen roller 4 is a component of a sheet feed mechanism. The print heads 5 jet yellow ink, magenta ink, cyan ink and black ink, respectively, for color printing. Each print head 5 is provided with a plurality of nozzles. The recording sheet P is fed into the ink jet printer 1 through a sheet inlet, not shown, formed in a back portion of the frame 3, advanced in the direction of the arrow A by the platen roller 4 and delivered from the ink jet printer through a sheet outlet opening, not shown.

A carriage 6 is supported for movement in the directions of the double-end arrow B parallel to the axis of the platen roller 4 and on the front side of the platen roller 4. The carriage 6 is mounted on a carriage support shaft 8 disposed with its axis in parallel to that of the platen roller 4. Four ink cartridges 7A, 7B, 7C, 7D containing the ink to be supplied to the print heads 5 are detachably mounted on the carriage 6. The print heads 5 jet the ink for printing as the carriage 6, carrying the print heads 5, moves past the recording sheet P which is supported on the platen roller 4. A carriage driving motor 10 drives the carriage 6 by means of a belt 11 and pulleys 12, 13. The carriage driving motor 10 is a stepping motor or a DC motor.

A purging unit 15 (suction means) for restoring the print heads 5 to their normal condition when the print heads 5 malfunction or fail to function normally is disposed on the right-hand side of the ink jet printer 1, as viewed in FIG. 1, outside of the printing range in which the recording sheet P is printed. Sometimes, the ink jet print heads 5 malfunction during a printing operation due to the generation of bubbles in the ink contained in the ink cartridges 7A–7D or the printing heads 5 or the adhesion of ink particles to the print heads' 5 jetting surfaces. Therefore, the ink jet printer 1 is provided with the purging unit 15 to restore the print heads 5 to their normal condition after the print heads 5 malfunction or to prevent a malfunction.

The purging unit 15 will be described in further detail. The purging unit 15 is provided with a suction cap 16. The suction cap 16 is set over the nozzles of a print head 5, a vacuum is created in the suction cap 16 by a pump 17 to suck out the faulty ink from the print head 5 so that the print head 5 is restored to its normal condition. The faulty ink sucked from the print head 5 is sent to an ink storage unit 18. A wiper 19, for wiping the nozzles of the print head 5, is attached to a portion of the purging unit 15 on the side of the printing range. The four print heads 5 are subjected individually to a faulty ink sucking operation using the suction cap 16 and to a wiping operation by the wiper 19. The purging unit 15 is driven by a line feed motor 40 (FIG. 2) for driving the platen roller 4. The driving force of the line feed motor 40 is transmitted through a pump driving cam gear 25 to the purging unit 15 when the carriage 6 enters an upkeeping range R. A power transmission mechanism 30 for transmitting the driving force of the line feed motor 40 to the purging unit 15 will be described later.

A guide rod 20 extends in parallel to the direction of movement of the carriage 6 and away from the printing range to beyond the purging unit 15. A print head cap support member 23 supporting a print head cap 21 is mounted on the guide rod 20 so as to be axially slidable along and turnable on the guide rod 20. The print head cap 21 covers the print heads 5 while the ink jet printer 1 is not printing to prevent the ink remaining in the nozzles of the print heads 5 from drying. The print head cap 21 has a plurality of cap sections. The number of the cap sections is equal to the number of the print heads 5. In this embodiment, the print head cap 21 has four cap sections for the four print heads 5. The print head cap support member 23 is provided with a projection 23A with which the carriage 6 comes into engagement. After the carriage 6 has engaged with the projection 23A, the print head cap support member 23 supporting the print head cap 21 slides along the guide rod 20 together with the carriage 6 as the carriage 6 moves. The print head cap support member 23 is turned toward the print heads 5 while the print heads 5 move with the carriage 6 to cap the print heads 5 with the print head cap 21. A mechanism for turning the print head cap support member 23 will be described later.

Figure 2:
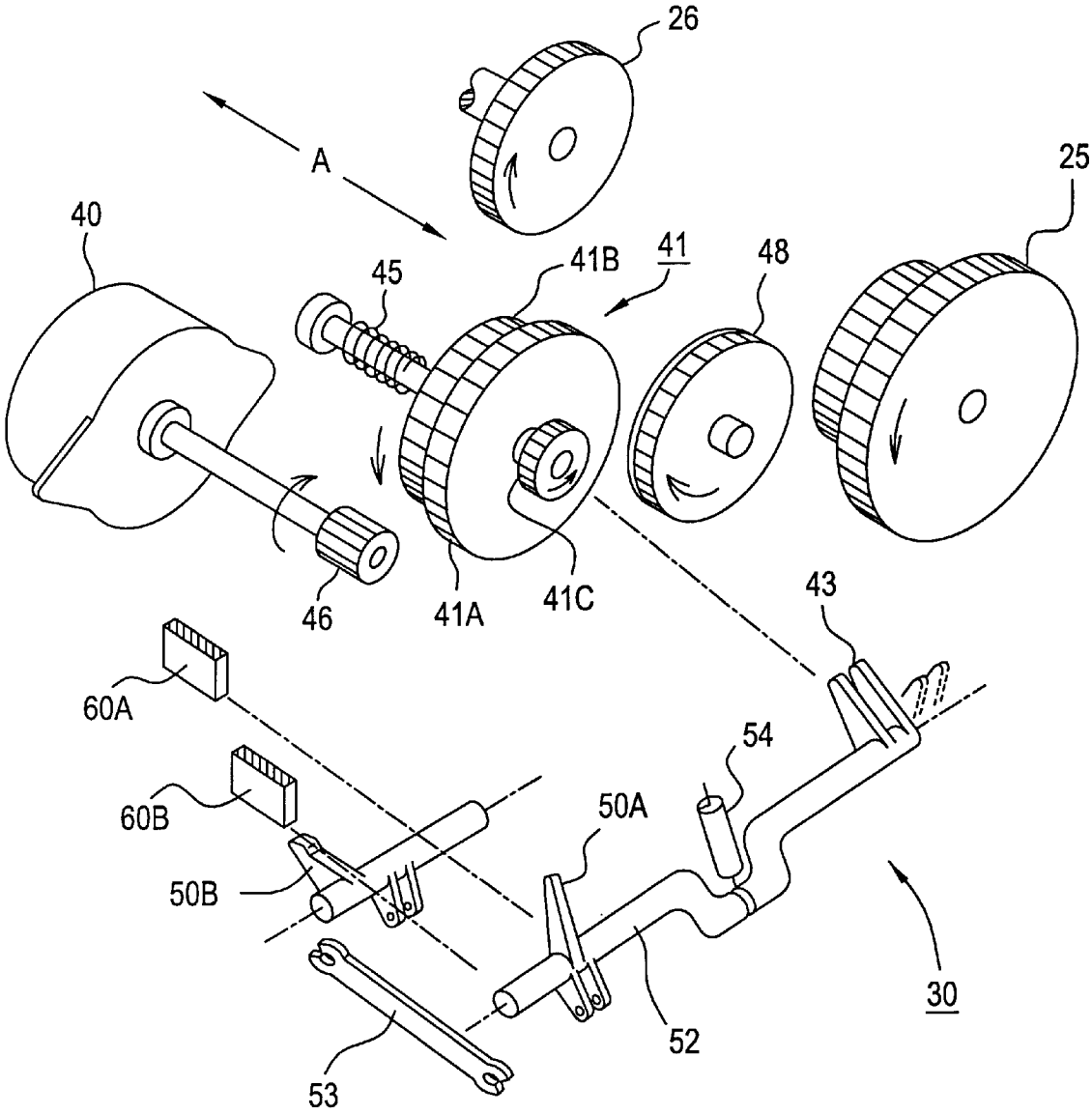
FIG. 2 is an exploded perspective view of a transmission mechanism for transmitting the driving force of a line feed motor to a purging unit.

The power transmission mechanism 30 for transmitting the driving force of the line feed motor 40 to the purging unit 15 will be described with reference to FIG. 2, showing the power transmission mechanism in an exploded perspective view. The power transmission mechanism 30 comprises a compound gear 41 driven by the line feed motor 40 and capable of being axially moved in the directions of the double-end arrow A, an idle kicker 43 for axially pushing the compound gear 41 to move the compound gear 41 axially, and a compression spring 45 biasing the compound gear 41 to the right, as viewed in FIG. 2.

Figure 3A:
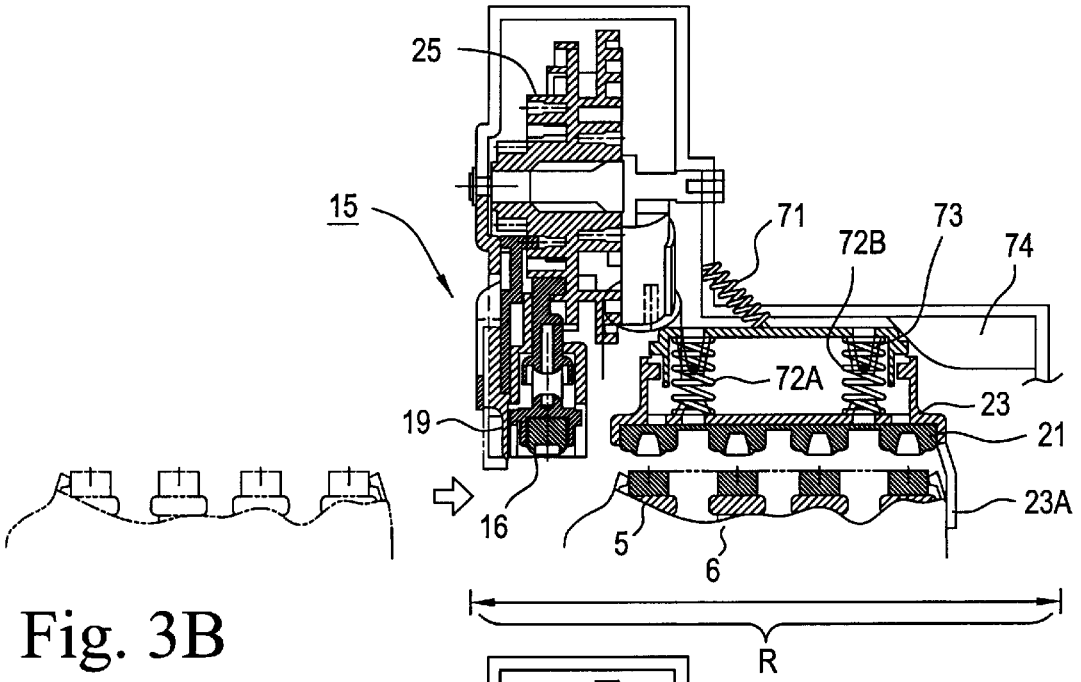
FIG. 3A is a horizontal sectional view of a print head cap and a print head capping mechanism in a state where print heads are not capped with the print head cap.

The compound gear 41 has three gears, i.e., a first gear 41A meshed with a motor pinion 46 attached to the output shaft of the line feed motor 40, a second gear 41B meshed with a platen gear 26 attached to the shaft 2 of the platen roller 4, and a third gear 41C for driving the pump driving cam gear 25 through a purge gear 48. The first gear 41A and the motor pinion 46 are always in mesh with one another. The second gear 41B and the platen gear 26 are in mesh with each other when the carriage is in a printing range. Further, the purge gear 48 and the pump driving cam gear 25 are always in mesh with each other. The third gear 41C comes into engagement with the purge gear 48 after the carriage 6 has entered the range R (FIG. 3A).

The idle kicker 43 and a first kicker 50A are formed on a first kicker shaft 52 supported for turning about its axis. The first kicker shaft 52 is turned to move the idle kicker 43 between a position indicated by continuous lines and a position indicated by alternate long and two short dashes lines. A second kicker shaft 52A provided with a second kicker 50B is disposed nearer the printing range than the first kicker shaft 52. The first kicker 50A and the second kicker 50B are interconnected by a connecting member 53. The first kicker 50A is in a standing position when the second kicker 50B is in a lying position and vice versa, that is, the first kicker 50A and the second kicker 50B are offset approximately 90° from one another. The first kicker 50A and the second kicker 50B are spaced apart with respect to a direction perpendicular to the direction of movement of the carriage 6.

One end of an extension spring 54 is connected to a middle crank portion of the first kicker shaft 52. The first kicker 50A is set in the standing position when the joint of the extension spring 54 and the crank portion of the first kicker shaft 52 is turned to one side of the axis of the first kicker shaft 52, and the first kicker 50A is set in the lying position when the joint is turned to the other side of the axis. A pair of stoppers, not shown, stop the first kicker 50A in the standing position and the lying position, respectively. The contractile resilience of the extension spring 54 is higher than the expansive resilience of the compression spring 45.

The idle kicker 43 is in a position indicted by continuous lines when the first kicker 50A is in the standing position and is in a position indicated by alternate long and two short dashes lines when the first kicker 50A is in the lying position. The first kicker 50A is kept in the standing position while the carriage 6 is in the printing range. The first kicker 50A and the second kicker 50B are positioned so as to project into the path of the carriage 6 when standing. The first kicker 50A is at the starting point of the range R, and the second kicker 50B is at a position at the side of and closer to the printing range than the first kicker 50A. The carriage 6 is provided on its lower surface with a first operating projection 60A and a second operating projection 60B, which are spaced apart with respect to a direction perpendicular to the moving direction of the carriage 6. The first operating projection 60A is on the side of the printing range with respect to the second operating projection 60B.

The actions of the kickers and the operating projections, and modes of driving force transmission through the gears during the movement of the carriage 6 will be described hereinafter. The idle kicker 43 is kept in the position indicated by continuous lines in FIG. 2 by the resilience of the extension spring 54 while the carriage is in the printing range. In this state, the idle kicker 43 biases the compound gear 41 to the left, as viewed in FIG. 2, against the resilience of the compression spring 45. Therefore, the third gear 41C is disengaged from the purge gear 48 and hence the pump driving cam gear 25 is not driven. When the carriage 6 moves from the printing range into the range R, the first operating projection 60A pushes the first kicker 50A down to the lying position to set the idle kicker 43 in the position indicated by long and two short dashes lines in FIG. 2. Consequently, the pressure applied to the compound gear 41 by the idle kicker 43 is removed. Although the second operating projection 60B enters the range R before the first operating projection 60A comes into engagement with the first kicker 50A, the first kicker 50A is not kicked down by the second operating projection 60B because the first kicker 50A is positioned off the path of the second operating projection 60B as shown in FIG. 2.

When the pressure is removed from the compound gear 41, the compound gear 41 is moved to the right, as viewed in FIG. 2, by the expansive resilience of the compression spring 45 and, consequently, the third gear 41C engages with the purge gear 48 to transmit the driving force of the line feed motor 40 to the pump driving cam gear 25 so that a vacuum can be created inside the suction cap 20 of the purging unit 15. Further, when the first kicker 50A is thus kicked down to the lying position, the second kicker 50B is raised to the standing position via the connecting member 53.

After an upkeeping operation for cleaning the print heads 5 has been completed and the carriage 6 has started traveling toward the recording range for printing, the second operating projection 60B kicks down the standing second kicker 50B to the lying position. Although the first operating projection 60A reaches a position corresponding to the second kicker 50B before the second operating projection 60B, the second kicker 50B is not kicked down by the first operating projection 60A because the second kicker 50B is off the path of the first operating projection 60A. Thus, through the connecting member 53 the idle kicker 43 is returned to the position indicated by continuous lines in FIG. 2 to push the compound gear 41 to the left. Consequently, the third gear 41C of the compound gear 41 is again disengaged from the purge gear 48 and the transmission of the driving force of the line feed motor 40 to the pump driving cam gear 25 is interrupted.

In this ink jet printer, the distance to be traveled by the carriage 6 from a point where the first operating projection 60A kicks the first kicker 50A to a point where the second operating projection 60B kicks the second kicker 50B is greater than the geometric distance between the first kicker 50A and the second kicker 50B along the moving direction of the carriage 6. Therefore, a range for the movement of the carriage 6 necessary for the cleaning operation can be secured even if the geometric distance between the first kicker 50A and the second kicker 50B along the moving direction of the carriage 6 is relatively short. As a result, the ink jet printer can be formed having a relatively small size. The first operating projection 60A of the carriage 6 kicks down the first kicker 50A and the compound gear 41 engages with the purge gear 48 upon the engagement of the carriage with the projection 23A of the print head cap support member 23 during travel away from the printing range in the range R. The second operating projection 60B kicks down the second kicker 50B and thereby the compound gear 41 is disengaged from the purge gear 48 and is brought into engagement with the platen gear 26 upon the departure of the nozzles of the rightmost print head 5, as viewed in FIG. 1, from the range R while the carriage 6 is traveling away from the range R.

Figure 3B:
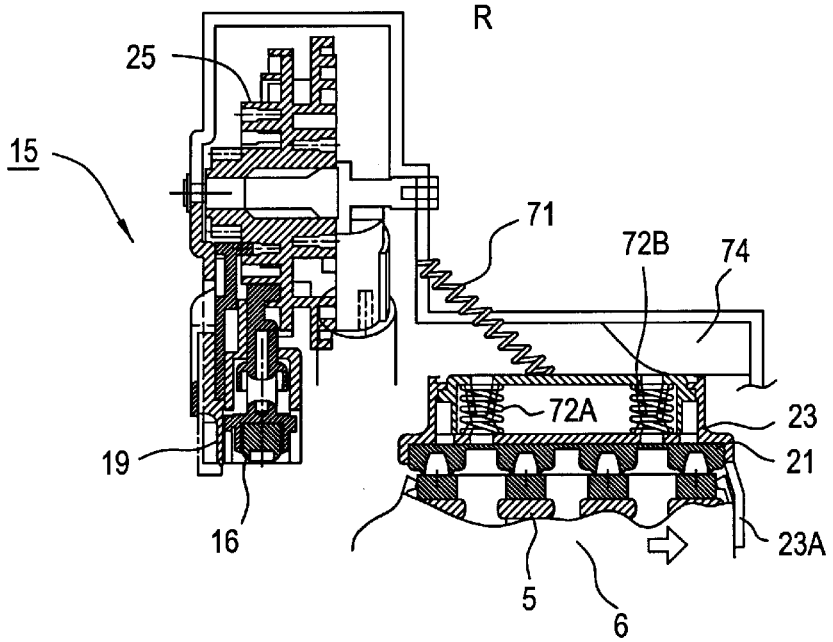
FIG. 3B is a horizontal sectional view of the print head cap and the print head capping mechanism in a state where the print heads are capped with the print head cap.

A print head capping mechanism for capping the print heads 5 with the print head cap 21 will be described hereinafter with reference to FIGS. 3A and 3B. FIG. 3A is a horizontal sectional view of the print head cap 21 and the print head capping mechanism in a state where the print heads 5 are not capped with the print head cap 21 and FIG. 3B is a horizontal sectional view of the print head cap 21 and the print head capping mechanism in a state where the print heads 5 are capped with the print head cap 21. As mentioned above, the print head cap support member 23 supporting the print head cap 21 is mounted on the guide rod 20 so as to be axially slidable along and turnable on the guide rod 20. The print head cap support member 23 is biased toward the printing range and away from the print heads 5 by a spring 71.

The print head cap 21 is supported on the print head cap support member 23 so as to be movable toward and away from the print heads 5. Springs 72A, 72B extend between the print head cap 21 and the print head cap support member 23. An operating member 73 is disposed over the springs 72A, 72B. The print head cap 21 is biased toward the print heads 5 by the expansive resilience of the springs 72A, 72B. A cam member 74 for converting the sliding movement of the print head cap support member 23 into the movement of the print head cap 21 in a direction perpendicular to the moving direction of the print head cap support member 23 has a cam surface inclined so as to deviate toward the print heads 5 from the moving direction of the carriage 6 away from the printing range.

After the carriage 6 (indicated by continuous lines in FIG. 3A) has moved from the printing range into the range R and has engaged with the projection 23A, the print head cap 21 moves together with the carriage 6 and the first operating projection 60A kicks the first kicker 50A. As the carriage 6 moves to the right in the range R, the print head cap support member 23 slides along the cam member 74. Consequently, the print head cap 21 is forced to move toward and brought into contact with the print heads 5 by the cam member 74. As the carriage 6 moves further to the right, the springs 72A and 72B are compressed between the print head cap support member 23 and the print head cap 21 and, consequently, the capping sections of the print head cap 21 are pressed by a uniform pressure against the nozzles of the print heads 5, respectively, as shown in FIG. 3B. When the carriage 6 moves toward the printing range, the print head cap support member 23 supporting the print head cap 21 is pulled toward the printing range by the spring 71 and the print head cap 21 is separated from the print heads 5. Upon the departure of the carriage 6 from the range R, the print head cap 21 is returned to the initial position shown in FIG. 3A.

Figure 4B:
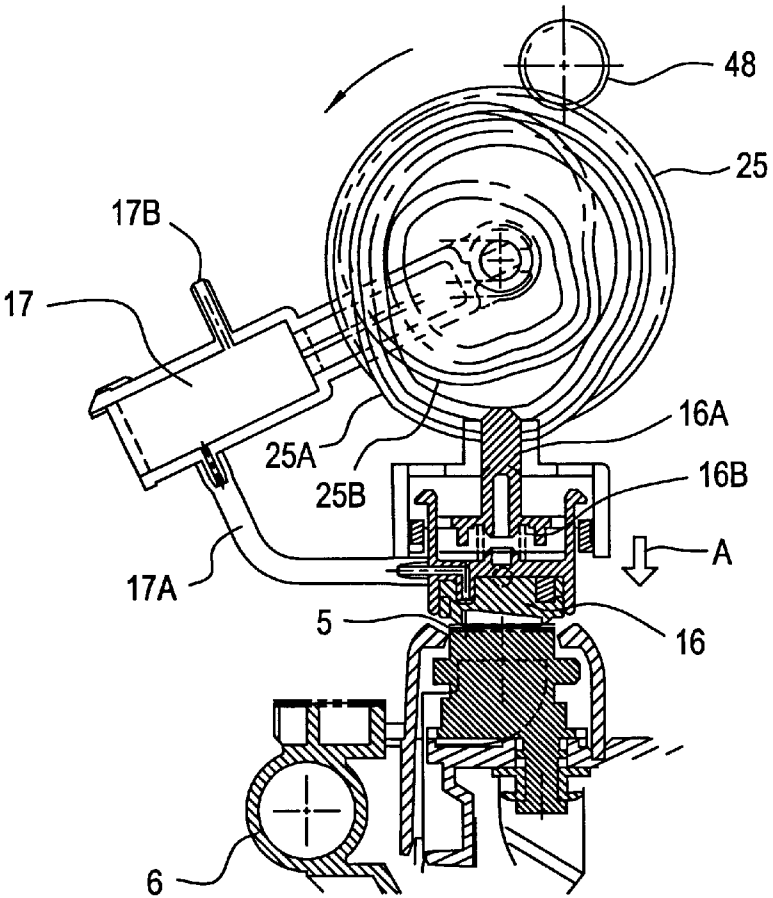
FIG. 4B is a longitudinal sectional view of the print head cap and the purging unit operating mechanism in a state where the print heads are capped with the print head cap.
Figure 4A:
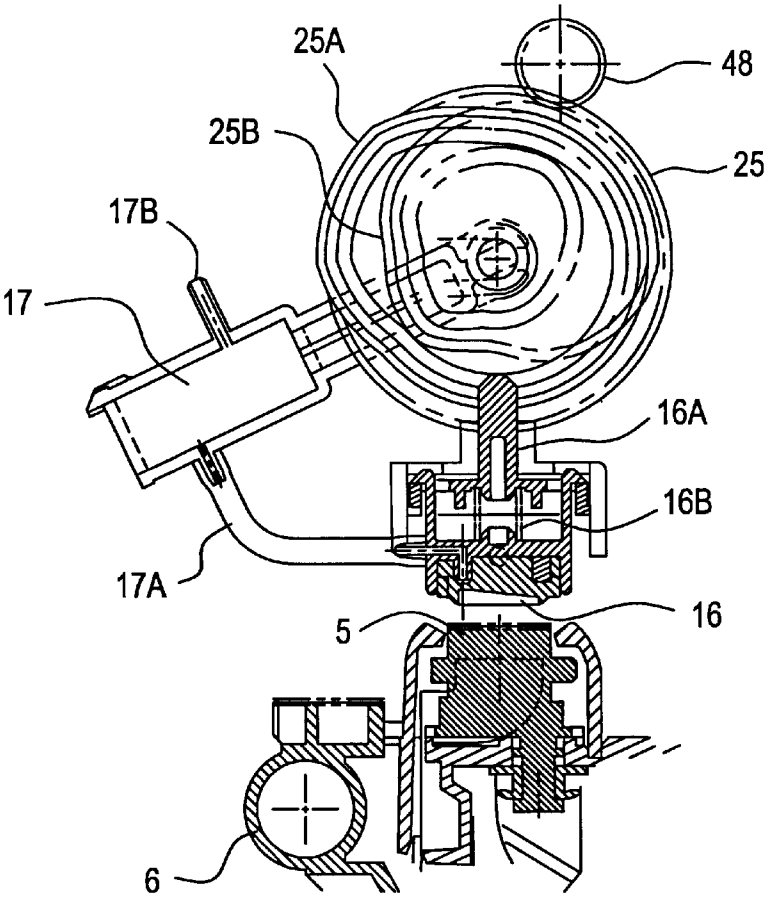
FIG. 4A is a longitudinal sectional view of the print head cap and a purging unit operating mechanism in a state where the print heads are not capped with the print head cap.

A purging unit operating mechanism for operating the purging unit 15 to clean the print heads 5 will be described with reference to FIGS. 4A and 4B. FIG. 4A is a longitudinal sectional view of the suction cap 16 and the purging unit operating mechanism in a state before the cleaning operation, where a print head 5 is not capped with the suction cap 16 and FIG. 4B is a longitudinal sectional view of the suction cap 16 and the purging unit operating mechanism in a state during the cleaning operation, where a print head 5 is capped with the suction cap 16. As mentioned above, the purging unit 15 is driven by the driving force of the line feed motor 40 transmitted to the pump driving cam gear 25 through the purge gear 48. The pump driving cam gear 25 is provided with a first cam 25A for moving the suction cap 16 toward the print heads 5, and a second cam 25B for operating the wiper 19 (FIGS. 3A, 3B, 4A and 4B). The suction cap 16 is provided with a spring 16B for pressing the suction cap 16 against the print heads 5 by a fixed pressure, and a cam follower 16A in sliding contact with the first cam 25A to move the suction cap 16 in the direction of the arrow A (FIG. 4B). The pump 17 is driven by a third cam 25C provided on the pump driving cam gear 25. The suction cap 16 is connected to the pump 17 by a suction tube 17A, and the pump 17 is connected to the ink storage unit 18 by a discharge tube 17B. The third cam 25C is designed so that the pump 17 is driven to suck ink from the suction cap 16 when the suction cap 16 is advanced to the print head 5. The second cam 25B of the pump driving cam gear 25 is for moving the wiper 19 and is designed so that the wiper 19 is advanced when the suction cap 16 is retracted.

When the driving force of the line feed motor 40 is transmitted through the foregoing mechanisms to the purging unit 15, the pump driving cam gear 25 is rotated. When the protruded portion of the first cam 25A is rotated to a position in contact with the cam follower 16A, by the rotation of the pump driving cam gear 25, the cam follower 16A is pressed toward the print head 5 by the first cam 25A of the pump driving cam gear 25, and the suction cap 16 is moved toward the selected print head 5 for capping (FIG. 4B). Then, the pump 17 is operated by the third cam to suck out the faulty ink in the print head 5 through the suction tube 17A and the sucked, faulty ink is sent through the discharge tube 17B to the ink storage unit 18.

A series of operations of the ink jet printer 1 thus structured will be described hereinafter. After a printing operation has been completed, the carriage 6 is moved from the printing range into the range R. Then, the carriage 6 engages with the projection 23A of the print head cap support member 23, the print head cap support member 23 moves together with the carriage 6. While the print head cap support member 23 is moving together with the carriage 6, the operating member 73 is pressed by the cam 74 to move the print head cap 21 toward the print heads 5. Upon the arrival of the carriage 6 at the extremity of the range R, the print heads 5 are capped perfectly with the print head cap 21. When the carriage 6 enters the range R, the first operating projection 60A kicks down the first kicker 50A and thereby the compound gear 41 is brought into engagement with the purge gear 48.

When no print data is given to the ink jet printer 1 and no cleaning instruction requiring cleaning a specified one of the print heads 5 is given, the foregoing state is maintained. When a cleaning instruction requiring cleaning of one of the print heads 5 is given, the carriage 6 is moved to position the print head 5 specified by the cleaning instruction opposite to the suction cap 16. The print head cap 21 is separated from the print heads 5 when the carriage moves to position the print head 5 specified by the cleaning instruction opposite to the suction cap 16. Upon the arrival of the specified print head 5 at the position opposite the suction cap 16, the line feed motor 40 is actuated, the driving force of the line feed motor 40 is transmitted through the compound gear 41 and the purge gear 48 to the pump driving cam gear 25 to rotate the pump driving cam gear 25. Consequently, the suction cap 16 is advanced toward the print head 5 and set in close contact with the nozzles of the specified print head 5 and the pump 17 is driven to suck the faulty ink from the nozzles of the print head 5.

Upon the completion of the suction of the faulty ink, the suction cap 16 is retracted, the wiper 19 is advanced, and the carriage 6 is moved so that the nozzles of the specified print head 5 moves across the wiper 19 to wipe the nozzles of the specified print head 5. After the pump driving cam gear 25 has made one full turn, the line feed motor is stopped. Then, the carriage 6 is moved into a flashing range outside the printing range and the range R, and ink is discharged from all the ink ejecting nozzles of the print head 5 for a flashing operation. When the plurality of print heads 5 need cleaning, the foregoing cleaning and flashing operations are repeated for each print head 5.

As is apparent from the foregoing description, in the ink jet printer 1 of this embodiment, because the print head cap 21 is operated for capping by the movement of the carriage 6, and the purging unit 15 is driven by the driving force of the line feed motor 40 for driving the platen roller 4, the ink jet printer 1 need not be provided with any additional driving means for driving the print head cap 21 and the purging unit 15. Hence, the ink jet printer 1 can be manufactured at a relatively low cost. Because the capping operation for capping the print heads 5 with the print head cap 21 is started when the carriage 6 moves out of the printing range, the capping operation can be accomplished in a time shorter than a time required by a conventional capping operation which is started after the carriage 6 has arrived and stopped at a predetermined position. Since the movement of the print head cap 21 toward the print heads 5 is started in perfect synchronism with the movement of the carriage 6, the operations of the carriage 6 and the print head cap 21 are accurately synchronized. Because the suction cap 16 and the wiper 19 are advanced and retracted by the first cam 25A and the second cam 25B of the pump driving cam gear 25, respectively, the operations of the suction cap and the wiper 19 are perfectly synchronized with the sucking operation of the pump 17.

The invention is not limited in its practical application to the foregoing embodiment specifically described herein and many changes and variations are possible therein. For instance, although the foregoing embodiment advances the suction cap 6 toward the print head 5 after the nozzles of the specified print head 5 have been positioned opposite to the suction cap 16, the pump driving cam gear 25 may be driven for rotation by actuating the line feed motor 40 when the carriage 6 is moved to an optional position outside the printing range.

What is claimed is:

1. An ink jet printer, comprising:

a carriage carrying a print head having nozzles through which ink is jetted onto a recording medium;

a print head cap for capping the print head to prevent ink in the nozzles of the print head from drying, said print head cap disposed outside a printing range in which the recording medium is printed;

a print head cap support member for supporting said print head cap disposed so as to engage with the carriage moving toward a capping position where the print head is positioned opposite to the print head cap, said print head cap support member driven by contact with the moving carriage so as to move the print head cap toward the print head to cap the print head with the print head cap;

a suction device disposed outside a printing range in which the recording medium is printed comprising a suction cap for placement over the nozzles of the print head, and a suction pump for sucking ink from the nozzles of the print head through the suction cap; and a suction device driver having a first driving source for driving the suction device, wherein the print head cap support member comprises a first print head cap moving member for moving the print head cap in substantially the same direction as that of movement of the carriage when the carriage engages with the first print head cap moving member, and a second print head cap moving member for moving the print head cap in a direction substantially perpendicular to the direction of movement of the carriage as the first print head cap moving member moves together with the carriage, the second print head cap moving member is a cam having a cam surface inclined so that the print head cap moves toward the print head.

2. The ink jet printer as claimed in claim 1, further comprising:

a recording medium feeding element for feeding a recording medium; and a second driving source for driving the recording medium feeding element, wherein the second driving source serves also as the first driving source of the suction device driver for driving the suction device.

3. The ink jet printer as claimed in claim 2, wherein the suction device driver has a first cam for moving the suction cap toward and away from the print head and a second cam for driving the suction pump.

4. The ink jet printer as claimed in claim 3, wherein the suction device driver connects the second driving source to the first cam and the second cam substantially simultaneously with engagement of the carriage with the first print head cap moving member.

5. The ink jet printer as claimed in claim 4, wherein the suction device is closer to the printing range than the print head cap support member and print head cap.

6. The ink jet printer as claimed in claim 5, wherein the carriage is moved to the capping position where the print head cap can be brought into close contact with the nozzles of the print head, and then is moved further toward the suction cap to make the suction device carry out a sucking operation.

7. The ink jet printer as claimed in claim 3, wherein when the carriage moves to the capping position, the second driving source is disengaged from driving the recording medium feeding element and is engaged to the suction device driver.

8. An ink jet printer, comprising:

a carriage having at least one print head with associated ink cartridge;

a print head cap for capping the at least one print head at a capping position when the carriage moves outside a printing range of the ink jet printer;

a print head cap support member disposed for engagement by the carriage moving toward the capping position;

means for moving the print head cap to cap the at least one print head substantially when the carriage arrives at the capping position;

a suction device disposed outside the printing range comprising a suction cap for placement over a print head of the at least one print head, and a suction pump for sucking ink from the nozzles of the print head through the suction cap;

a driver for driving the suction device using a driving force of a driving source for a recording medium conveying element for conveying a recording medium;

a driving force transmitting element for transmitting a driving force of the driver in a first driving force transmitting state for driving the suction device when the at least one print head is moved out of the printing range by the moving carriage, and for transmitting a driving force of the driver in a second driving force transmitting state for driving the recording medium conveying element when the at least one print head is moved into the printing range by the moving carriage; and a suction device driver connected to the driving force transmitting element in the first driving force transmitting state, the suction device driver including a first cam for moving the suction cap toward and away from the print head of the at least one print head and a second cam for driving the suction pump.

9. The ink jet printer as claimed in claim 8, wherein the print head cap support member is movable in a same direction as the carriage by the moving carriage when engaged by the carriage and the means for moving the print head cap moves the print head cap in a direction perpendicular to the direction the carriage is moving as the carriage moves.

10. The ink jet printer as claimed in claim 9, wherein the means for moving the print head cap is a cam having a surface inclined toward a path traversed by the carriage during movement.

11. The ink jet printer as claimed in claim 10, wherein the suction device driver connects the driving source to a cam for moving the suction cap toward and away from the print head of at least one print head and a cam for driving the suction pump substantially simultaneously with the engagement of the carriage with the print head cap support member.

12. The ink jet printer as claimed in claim 8, further comprising:

a wiper for wiping the nozzles of the at least one print head, wherein the suction device driver has a third cam for controlling movement of the wiper, the third cam moving the wiper to contact the at least one print head when the suction cap has been withdrawn from the at least one print head by the first cam and vice versa.

* * * * *